US010023421B2

(12) United States Patent
Campanini

(10) Patent No.: US 10,023,421 B2
(45) Date of Patent: Jul. 17, 2018

(54) DISPENSING APPARATUS

(71) Applicant: Custom S.p.A., Fontevivo (IT)

(72) Inventor: Alberto Campanini, Fidenza (IT)

(73) Assignee: Custom S.p.A. (IT)

( * ) Notice: Subject to any disclaimer, the term of this patent is extended or adjusted under 35 U.S.C. 154(b) by 232 days.

(21) Appl. No.: 14/435,325

(22) PCT Filed: Oct. 16, 2013

(86) PCT No.: PCT/IB2013/059398
§ 371 (c)(1),
(2) Date: Apr. 13, 2015

(87) PCT Pub. No.: WO2014/060967
PCT Pub. Date: Apr. 24, 2014

(65) Prior Publication Data

US 2015/0259171 A1 Sep. 17, 2015

(30) Foreign Application Priority Data

Oct. 18, 2012 (IT) ..... MO2012A0252

(51) Int. Cl.
*G07B 5/02* (2006.01)
*G07B 3/02* (2006.01)
(Continued)

(52) U.S. Cl.
CPC ..... *B65H 35/008* (2013.01); *B26F 3/002* (2013.01); *B65H 35/0006* (2013.01); *G07B 5/02* (2013.01);
(Continued)

(58) Field of Classification Search
CPC ..... Y10T 225/215; Y10T 225/216; Y10T 225/217; Y10T 225/218; Y10T 225/277; Y10T 225/278; Y10T 225/279; Y10T 225/284; Y10T 225/252; Y10T 83/896; Y10T 83/902; Y10S 83/949; Y10S 83/95; G07B 5/00–5/12; G07B 3/02; B65H 35/008; B65H 35/0086; B65H 63/04; B65H 35/0006; B65H 35/04; B65H 35/06; B26F 3/02; A47K 2010/3675; A47K 2010/3863; A47K 2010/3872
See application file for complete search history.

(56) References Cited

U.S. PATENT DOCUMENTS 2,663,369 A * 12/1953 Erhardt ..... B65H 35/0026 225/20
5,407,115 A 4/1995 Blalock et al.
(Continued)

FOREIGN PATENT DOCUMENTS

FR 2796055 A1 * 1/2001 ..... G07B 5/02
WO 0137223 A1 5/2001

*Primary Examiner* — Stephen Choi
*Assistant Examiner* — Evan MacFarlane
(74) *Attorney, Agent, or Firm* — Laubscher, Spendlove & Laubscher, P.C.

(57) ABSTRACT

An apparatus and a method distributes printed slips or tickets that are obtained from a continuous strip of material in which the strip is cut by a stationary blade when the user tensions the strip by pulling an end thereof. A driven dragging roller that makes the strip advance in an intermittent manner is interrupted if a sensor detects that the strip is tensioned to be cut.

10 Claims, 2 Drawing Sheets

(51) Int. Cl.

| | |
|---|---|
| ***B65H 35/00*** | (2006.01) |
| ***B26F 3/00*** | (2006.01) |
| *G07B 5/08* | (2006.01) |

(52) U.S. Cl.
CPC .. *B65H 2515/31* (2013.01); *B65H 2701/1936* (2013.01); *G07B 3/02* (2013.01); *G07B 5/08* (2013.01); *Y10T 225/10* (2015.04); *Y10T 225/22* (2015.04)

(56) References Cited

U.S. PATENT DOCUMENTS

| | | | | |
|---|---|---|---|---|
| 6,598,773 | B1 * | 7/2003 | Daret | G07B 3/00 225/23 |
| 6,752,289 | B1 * | 6/2004 | Lin | G07B 3/02 221/26 |
| 9,254,578 | B2 * | 2/2016 | Wetsch | B26F 3/02 |
| 2006/0072953 | A1 | 4/2006 | Vienneau et al. | |
| 2006/0210344 | A1 * | 9/2006 | Montagutelli | B41J 11/70 400/621 |

* cited by examiner

DISPENSING APPARATUS

This application is a § 371 National Stage entry of PCT International Application No. PCT/IB2013/059398 filed Oct. 16, 2013. PCT/IB2013/059398 claims priority to IT Application No. MO2012A000252 filed Oct. 18, 2012. The entire content of these applications are incorporated herein by reference.

BACKGROUND OF THE INVENTION

The invention relates to a dispensing apparatus for dispensing receipts, slips or tickets from a continuous strip of material.

Specifically, but not exclusively, the invention can be used in a dispensing apparatus for dispensing receipts, slips or tickets located in a public place, for example a self-service fuel dispenser that automatically generates a payment receipt for the customer.

The invention can be advantageously applied in any situation in which it is necessary to separate, intermittently, receipts, slips or tickets from a relatively long continuous strip.

In particular, the present invention refers to a dispensing apparatus made in accordance with the preamble of the first claim.

Such a dispensing apparatus is already known, from example from patent publication US 2006/0210344.

One of the problems of known cutting apparatuses of this type is to coordinate the intermittent advancement of the strip, necessary for the issuing of the ticket, slip or receipt, with tensioning of the strip, which is necessary for the stationary blade to be able to cut the end portion of the strip that will form the ticket, slip or receipt.

In particular, there is the risk that the strip of paper is tensioned when the driven advancement device of the strip is still active. This could cause different drawbacks, such as, for example, an irregular cut of the ticket and/or an entanglement of the strip and/or incorrect printing of the ticket and/or failure to dispense the subsequent ticket.

SUMMARY OF THE INVENTION

One object of the invention is to provide a solution to the aforesaid problem of the prior art.

One advantage is to ensure regular advancement and/or printing and/or cutting of the strip.

One advantage is to make a dispensing apparatus that is usable in particular in a dispenser of tickets or receipts starting from a continuous strip of material, which is able to ensure regular and orderly movement of the strip.

One advantage is to prevent entanglement of the strip and/or incorrect printing of the ticket.

One advantage is to give rise to a constructionally simple and cheap dispensing apparatus.

Such objects and advantages and still others are achieved by the apparatus, by the use and by the method according to one or more of the claims set out below.

In one example, a dispensing apparatus comprises: a driven supply device arranged for making a strip of material advance along a preset path; a sensor that is able to send a signal indicating a strip tensioning situation (for cutting a ticket or receipt); an electronic control device that, in response to this signal, immediately interrupts any advancement of the strip by the supply device.

In one example, a method includes the steps of: providing a stationary blade along a supply path of a continuous strip of material; separating a receipt or ticket from the strip by cutting with the stationary blade when the strip is tensioned, for example by a user who pulls an end thereof; interrupting a driven supply device if a sensor detects that the strip has been tensioned for cutting.

BRIEF DESCRIPTION OF THE DRAWINGS

The invention can be better understood and implemented with reference to the attached drawings that illustrate one embodiment by way of non-limiting example.

DETAILED DESCRIPTION

Figure 1:
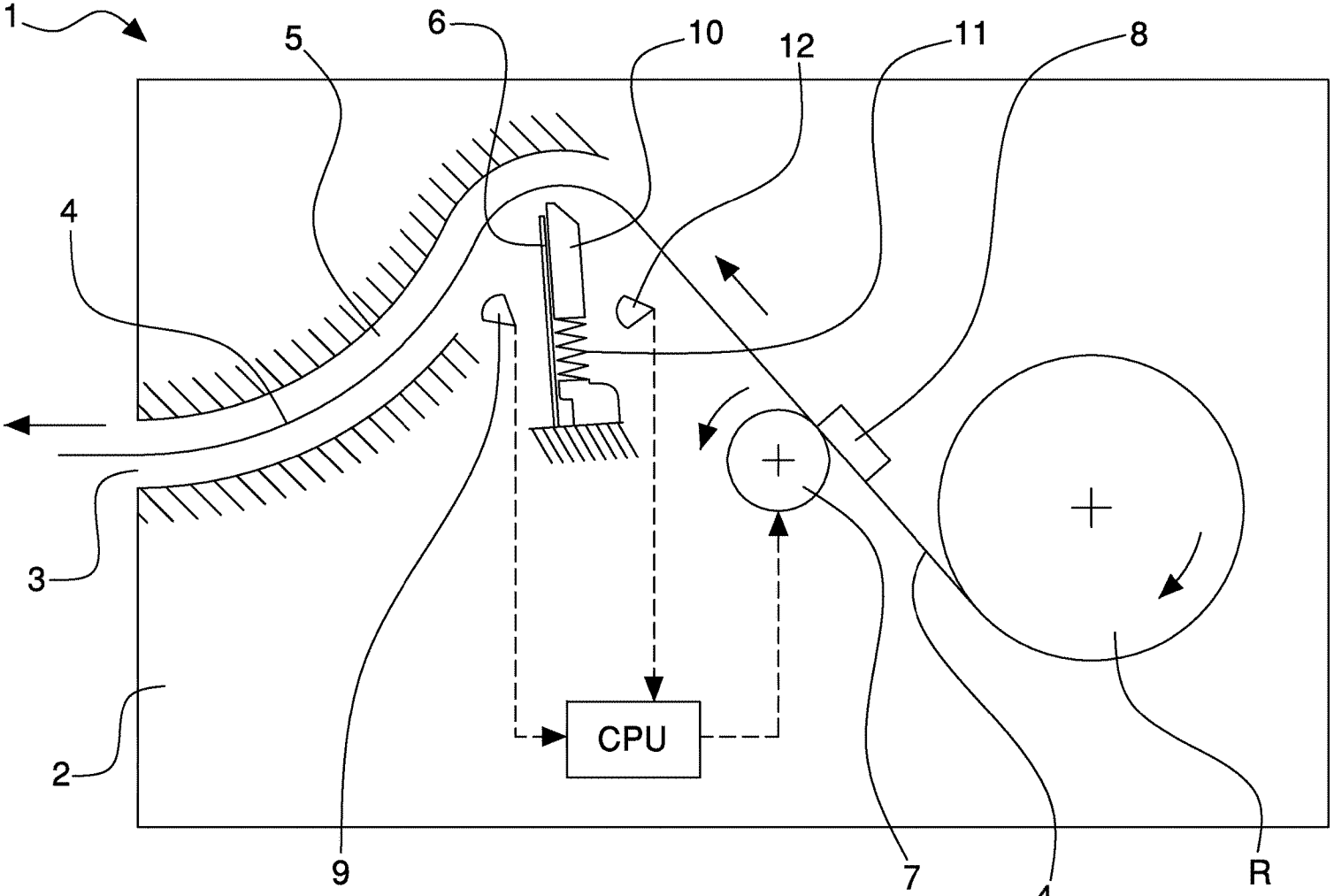
FIG. 1 is a diagram in a vertical elevation of one embodiment of the apparatus in question.

With reference to the above figures, an overall a dispensing apparatus 1 includes a housing 2 having an outlet 3 from which a user can receive a strip 4 of material, in particular paper or similar material. The housing 2 contains the various elements of the apparatus that will be described below. The housing 2 has a substantially box shape. The outlet 3 includes a horizontal slit that is suitable for the passage of the strip 4 and is arranged in an outlet opening on a front wall of a dispenser of tickets and/or receipts.

The dispensing apparatus 1 is used, in particular, for separating, intermittently, receipts, tickets, or similar objects (for example a receipt or ticket printed in real time, at the request of a user, just before cutting) from a continuous strip of relatively long material.

The dispensing apparatus 1 may be used in combination with a printing device as part of a distributor or dispenser of receipts and/or tickets printed from a continuous strip (made of paper or similar material).

The dispensing apparatus 1 is used for dispensing receipts and/or tickets in a public place. In an exemplary embodiment, the dispensing apparatus 1 is used in a self-service fuel dispenser that automatically generates a payment receipt for the customer.

In the specific example, the dispensing apparatus 1 includes a supply path 5 for the continuous strip. This path 5 will be at least partially arranged inside the housing 2. The strip advances to the outlet 3 and is guided to follow the supply path 5. In particular, the continuous strip 4 is guided by a guiding device including, for example, fixed guiding walls that convey the strip. The path 5 includes a roller guide of known type. In particular, the continuous strip is fed from a magazine R (for example a roll or a reel) that is housed inside the housing 2.

The dispensing apparatus 1 includes a stationary blade 6 for cutting the strip 4 along the supply path 5. In particular, the stationary blade 6 is arranged upstream (with reference to an advancement direction of the strip along the path 5) of the outlet 3. The stationary blade 6 has a cutting edge (for example of serrated or other type) extending transversely to the advancement direction of the strip 4, in particular, to the advancement direction that the strip will have at the blade 6. The supply path 5 of the strip includes a curve with the inner side facing the stationary blade 6. The stationary blade 6 includes a flat body, for example with a laminar shape, having the cutting edge.

The dispensing apparatus 1 further includes a supply device for supplying the strip intermittently along the supply path 5. In particular the supply device advances the strip until at least one end thereof emerges from the outlet 3. This end can be grasped by the user to pull and thus tension the strip to have the ticket or receipt separated by the stationary blade 6. Cutting the strip 4 to separate the receipt or the ticket may in fact be caused by the user, who tensions the strip by pulling the end thereof that exits the outlet.

The supply device is arranged along the supply path 5 upstream of the blade 6, in such a manner that the supply device is not able to tension the strip downstream of the blade. There are no strip advancement or dragging devices arranged downstream of the blade 6, i.e. arranged between the blade 6 and the outlet 3 of the strip 4.

The supply device includes a printing device such as a thermal printing device having at least one strip advancement roller 7. The printing device further includes a thermal printing head 8 cooperating with and opposite the advancement roller 7. The strip 4 will pass intermittently between the thermal printing head 8 and the advancement roller 7, to print the receipt or ticket in real time.

The printing device will be controlled by a (programmable) central processing unit CPU that will guide the intermittent advancement of the strip 4, in particular during the printing step.

The dispensing apparatus 1 includes a paper-finished sensor 9, for example a sensor without contact (optical, electromagnetic or other type of sensor). In the case in point, the paper-finished sensor 9 includes a photocell. The paper-finished sensor 9 is arranged between the stationary blade 6 and the outlet 3.

The dispensing apparatus 1 includes at least one movable element 10 moved by the strip 4 when the strip is tensioned for example by a user, as in this case, or by a mechanical tensioning device in other examples, for being cut. The movable element 10 is capable of movement between at least one first normal rest position and at least one second position that is moved with respect to the first position.

Figure 2:
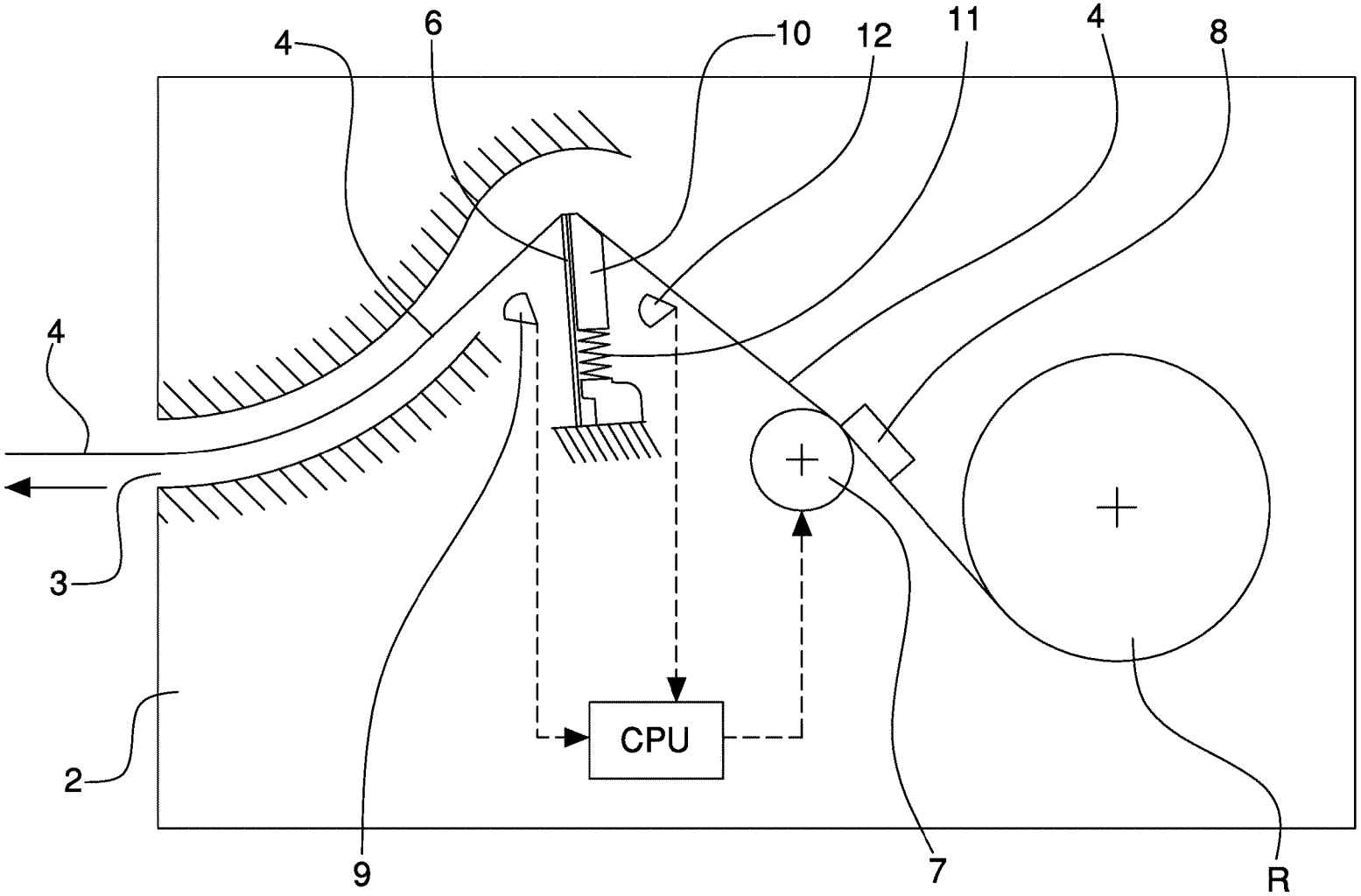
FIG. 2 shows the apparatus of FIG. 1 in a different operating configuration.

When the strip portion 4 arranged downstream of the blade 6 is not tensioned, the movable element 10 will be in the first normal rest position (FIG. 1). When the strip portion 4 arranged downstream of the blade 6 is tensioned to separate the ticket by cutting the blade 6, the taut strip 4 will push the movable element 10 towards the second position (FIG. 2).

The movable element 10 is arranged upstream of the stationary blade 6 with reference to the advancement of the strip 4. In the illustrated embodiment, the movable element 10 is arranged contiguously alongside the stationary blade 6. In other examples, which are not shown, the movable element could be arranged far from the stationary blade 6.

The movable element 10 is suitable for performing a rectilinear movement, as in the illustrated example, parallel to a plane defined by at least one part of the stationary blade 6 in particular a flat blade part, for example of laminar shape, that has the cutting edge. In other examples, which are not shown, the movable element may perform an oscillating movement, for example a-rotation around a hinge or around a rotation pivot.

The apparatus 1 includes an elastic element 11 such as at least one spring operating in contrast with the movement of the movable element 10 performed by the tensioned strip 4. The elastic element will bring the movable element 10 in the first normal rest position after the strip portion (ticket or receipt) has been separated by the blade 6, so that the strip 4 is no longer taut.

The movable element 10 is supported by the elastic element 11. The elastic element could include, in other examples that are not illustrated, an elastic hinge, an elastic lamina, an elastically deformable portion of the same movable element, and the like.

The dispensing apparatus 1 includes a sensor to detect the movement of the movable element 10 performed by the strip 4 tensioned to be cut. This sensor includes a proximity sensor or a sensor detecting the presence/absence of the movable element 10. This sensor includes, as in the specific example, a contactless sensor 12 (optical sensor, electromagnetic sensor, etc) operationally associated with the movable element 10 or with the elastic element 11. In particular, the contactless sensor 12 includes a photocell operationally associated with the movable element 10.

In one example that is not illustrated, the movable element includes an electric switch or pushbutton that can be moved by the strip from a first normal rest position (for example an open switch or pushbutton position) to a second position (for example a closed switch or pushbutton position) in which it is pressed by the tensioned strip. In this case, the sensor includes an electric contact that is opened or closed according to the position of the switch or pushbutton and which can send a corresponding opening or closing signal.

The dispensing apparatus 1 includes a control device (in particular of electronic type) configured for controlling the supply device in particular the printing device having the strip dragging roller 7, in response to signals received from the sensor 12. The control device includes a device for interrupting the advancement of the strip 4 by the supply device when the sensor 12 detects the movement of the movable element 10 performed by the strip 4 that has been tensioned for cutting. In the illustrated embodiment, the control device includes the central processing unit CPU which will be provided with the interrupting device that stops the advancement of the strip as soon as the strip is tensioned.

The central processing unit is programmable and the interrupting device include programme instructions that can be implemented by the control unit. Such programme instructions will implement a method for dispensing receipts or tickets that include at least the following steps: activating the driven supply device to intermittently supply the continuous strip 4 of material along the supply path 5 upon request of a ticket or receipt by a user; detecting via the sensor the movement of the movable element 10 by the strip when the strip is tensioned to be cut; interrupting the supply device if it is detected that, at the movement of the movable element 10, the supply device is still active, in order to immediately stop the supply of the strip 4 to prevent the driven advancement of the strip simultaneously with the cutting of the ticket or receipt.

In use, when the user pulls the strip end that protrudes outside the outlet 3 after printing the strip is tensioned to separate a ticket or receipt by cutting the strip portion 4 by the blade 6 and consequently the movable element 10 is lowered by the strip, which pushes the movable element 10 contrasting with the elastic element connected to the movable element. If, during this step of separating the ticket or receipt from the strip 4, the strip is still dragged forward by the roller 7 of the supply device, the central processing unit CPU will immediately stop the roller 7 to ensure that the strip, whilst it is tensioned downstream of the stationary blade 6 is not simultaneously dragged forward by driven supply device upstream of the stationary blade 6.

Owing to the fact that the apparatus in question envisages this situation (i.e. simultaneity of tensioning and driven advancement of the strip), the operation of the apparatus is safe, regular and reliable: in particular cutting is precise and complete, the formation of entanglements and jams is prevented, the issuing of the subsequent ticket is guaranteed, the printing of the ticket is correct.

The invention claimed is:

1. A dispensing apparatus for dispensing receipts, slips or tickets from a continuous strip of material, comprising:

a housing having an outlet;

a supply path at least partially arranged within said housing to supply a strip of material to said outlet;

a driven supply device for advancing the strip of material along said supply path;

a stationary blade arranged in said supply path between said driven supply device and said outlet for cutting the strip when the strip is tensioned, cutting of the strip being activated by a user who tensions the strip by pulling an end of the strip that exits said outlet, said outlet being arranged between said stationary blade and the user who pulls the end of the strip that exits said outlet, said stationary blade including at least one flat portion that has a cutting edge;

at least one movable element moved by the strip when the strip is tensioned to be cut, said movable element being designed to perform a rectilinear movement that is parallel to a plane defined by said at least one flat portion of said stationary blade, said movable element being arranged contiguously alongside and upstream of said stationary blade;

a sensor for detecting a said movement of said movable element performed by the strip tensioned for being cut; and a control device for controlling said supply device in response to signals received from said sensor;

wherein said control device includes a device for interrupting advancement of the strip by said supply device when said sensor detects the movement of said movable element by the tensioned strip.

2. A dispensing apparatus according to claim 1, wherein said supply device advances the strip along said path until said end of the strip exits said outlet.

3. A dispensing apparatus according to claim 1, wherein said supply device is arranged along said path upstream of said stationary blade without tensioning the strip downstream of said stationary blade.

4. A dispensing apparatus according to claim 1, and further comprising an elastic element operating in opposition to the movement of said movable element by the strip.

5. A dispensing apparatus according to claim 1, wherein said supply comprises a printing device having at least one strip advancement roller.

6. A dispensing apparatus according to claim 1, wherein said control device comprises an electronic control unit provided with said interrupting device.

7. A dispensing apparatus according to claim 6, wherein said electronic control unit is programmable and said interrupting device comprises programming instructions that are implementable by said control unit.

8. A dispensing apparatus according to claim 1, wherein said movable element has an edge that extends adjacent said cutting edge of said stationary blade.

9. A dispensing apparatus according to claim 8, wherein said movable element adopts a protruding position wherein at least one part of said edge protrudes beyond said cutting edge, and a recessing position wherein said at least one part of said edge is recessed relative to said cutting edge, said movable element normally being in said protruding position and being pushed by the strip from said protruding position to said recessing position when the strip is tensioned.

10. A method for dispensing printed receipts or tickets from a continuous strip of material using the apparatus according to claim 1.

* * * * *